US010008322B2

(12) United States Patent
Bhide et al.

(10) Patent No.: US 10,008,322 B2
(45) Date of Patent: Jun. 26, 2018

(54) FILTER ASSEMBLY AND METHOD

(71) Applicant: General Electric Company, Schenectady, NY (US)

(72) Inventors: Ravindra Shyam Bhide, Bangalore (IN); Ajith Kuttannair Kumar, Erie, PA (US); Lionel Durantay, Champigneulles (FR); Vandana Rallabandi, Bangalore (IN)

(73) Assignee: General Electric Company, Schenectady, NY (US)

( * ) Notice: Subject to any disclaimer, the term of this patent is extended or adjusted under 35 U.S.C. 154(b) by 133 days.

(21) Appl. No.: 14/746,163

(22) Filed: Jun. 22, 2015

(65) Prior Publication Data

US 2016/0125998 A1 May 5, 2016

Related U.S. Application Data

(60) Provisional application No. 62/069,946, filed on Oct. 29, 2014.

(51) Int. Cl.
*H01F 27/28* (2006.01)
*H01F 37/00* (2006.01)
(Continued)

(52) U.S. Cl.
CPC ..... *H01F 37/00* (2013.01); *H01F 27/263* (2013.01); *H01F 27/28* (2013.01); *H01F 41/0233* (2013.01)

(58) Field of Classification Search
CPC ..... H01F 5/00; H01F 27/00–27/36
(Continued)

(56) References Cited

U.S. PATENT DOCUMENTS 2,406,704 A * 8/1946 Mossay ..... H01F 30/12 307/156
2,702,887 A * 2/1955 Joublanc ..... H01F 30/12 336/215
(Continued)

FOREIGN PATENT DOCUMENTS

EP 1835604 A1 9/2007
GB 1415209 A 11/1975
(Continued)

OTHER PUBLICATIONS

Unofficial English Translation of Japanese Office Action issued in connection with corresponding JP Application No. 015206830 dated Nov. 22, 2016.
(Continued)

*Primary Examiner* — Tuyen Nguyen
(74) *Attorney, Agent, or Firm* — GE Global Patent Operation; John A. Kramer

(57) ABSTRACT

An electronic filter assembly includes a magnetically conductive annular body extending around a center axis, a set of magnetically conductive prongs radially extending from the center axis toward the annular body, and conductive windings extending around the prongs. The conductive windings can be disposed around the prongs instead of the annular body to assist in conduction of common mode magnetic flux, to reduce impedance of the filter assembly, and/or to more evenly distribute temperature in the filter assembly. A method for forming an electronic filter assembly includes forming an electronic filter assembly having a magnetically conductive annular body extending around a center axis and a set of magnetically conductive prongs radially extending from the center axis toward the annular body. The annular body and the prongs can be formed by coupling plural layers of magnetically conductive bodies together.

24 Claims, 9 Drawing Sheets

(51) Int. Cl.
*H01F 27/26* (2006.01)
*H01F 41/02* (2006.01)

(58) Field of Classification Search
USPC ..... 336/65, 83, 170, 173, 213–205
See application file for complete search history.

(56) References Cited

U.S. PATENT DOCUMENTS

| | | | | |
|---|---|---|---|---|
| 4,156,897 | A * | 5/1979 | Vigh | H01F 30/12 336/12 |
| 4,234,862 | A * | 11/1980 | Prevotat | H01F 27/25 336/212 |
| 4,482,945 | A | 11/1984 | Wolf et al. | |
| 4,912,618 | A | 3/1990 | Krinickas, Jr. | |
| 4,975,670 | A * | 12/1990 | Krinickas, Jr. | H01F 27/303 336/197 |
| 5,003,277 | A | 3/1991 | Sokai et al. | |
| 5,371,485 | A | 12/1994 | Manimalethu | |
| 5,537,089 | A * | 7/1996 | Greif | H01F 30/12 336/12 |
| 5,982,262 | A | 11/1999 | Levin | |
| 6,873,237 | B2 * | 3/2005 | Chandrasekaran et al. | H01F 3/08 336/170 |
| 7,554,431 | B2 * | 6/2009 | Dahlgren | H01F 27/255 336/233 |
| 7,768,373 | B2 | 8/2010 | Shudarek | |
| 8,115,582 | B2 | 2/2012 | Chen et al. | |
| 8,587,398 | B2 | 11/2013 | Wu et al. | |
| 8,653,931 | B2 * | 2/2014 | Xu | H02P 9/02 336/234 |
| 2003/0198067 | A1 | 10/2003 | Sun et al. | |
| 2003/0206087 | A1 | 11/2003 | Raff | |
| 2004/0085173 | A1 | 5/2004 | Decristofaro et al. | |
| 2006/0197511 | A1 | 9/2006 | AF Klercker Alakula | |
| 2007/0217103 | A1 | 9/2007 | AF Klercker Alakula et al. | |
| 2009/0261939 | A1 | 10/2009 | Shudarek | |
| 2010/0295645 | A1 | 11/2010 | Faelldin et al. | |
| 2011/0080246 | A1 | 4/2011 | Chen et al. | |
| 2014/0286068 | A1 | 9/2014 | Allaert et al. | |
| 2017/0040099 | A1 | 2/2017 | Bhide et al. | |

FOREIGN PATENT DOCUMENTS

| | | | |
|---|---|---|---|
| JP | 4943123 | A | 4/1974 |
| JP | 03502279 | A | 5/1991 |
| JP | 09232164 | A | 9/1997 |
| JP | 2010074132 | A | 4/2010 |
| JP | 2010-263238 | A | 11/2010 |
| JP | 2013-042028 | A | 2/2013 |
| JP | 2013-074084 | A | 4/2013 |
| JP | 2014183320 | A | 9/2014 |

OTHER PUBLICATIONS

Charley., "Recent Progress in Large Transformers", Journal of the Institution of Electrical Engineers, vol. No. 59, Issue No. 418, pp. 1189-1207, Oct. 1931.

Walker., "The Excitation Requirements of 3-phase Core-type 3-legged Y-Connected Transformers", AIEEE Transactions, pp. 1113-1119, Dec. 1957.

Ngnegueu et al., "Zero Phase Sequence Impedance and Tank Heating Model for Three Phase Three Leg Core Type Power Transformers Coupling Magnetic Field and Electric Circuit Equations in a Finite Element Software", IEEE Transactions on Magnetics, vol. No. 31, Issue No. 03, pp. 2068-2071, May 1995.

Escarela-Perez et al., "Asymmetry During Load-Loss Measurement of Three-Phase Three-Limb Transformer", IEEE Transactions on Power Delivery, vol. No. 22, Issue No. 03, pp. 1566-1574, Jul. 2007.

Escarela-Perez et al., "Analytical Description of the Load-Loss Asymmetry Phenomenon in Three-Phase Three-Limb Transformers", IEEE Transactions on Power Delivery, vol. No. 24, Issue No. 02, pp. 695-702, Apr. 2009.

Bhide et al., "Analysis of Five-Legged Transformer Used for Parallel Operation of Rectifiers by Coupled Circuit-Field Approach", IEEE Transactions on Power Delivery, vol. No. 26, Issue No. 02, pp. 607-616, Apr. 2011.

PCT Search Report and Written Opinion issued in connection with Related PCT Application No. PCT/US2014/031466 dated Dec. 3, 2014.

International Preliminary Report on Patentability issued in connection with Related PCT Application No. PCT/US2014/031466 dated Sep. 29, 2016.

Unofficial English Translation of Chinese Office Action issued in connection with corresponding CN Application No. 201510714579.2 dated Apr. 19, 2017.

Unofficial English Translation of Japanese Office Action issued in connection with corresponding JP Application No. 2015206830 dated May 16, 2017.

Second Office Action and Search issued in connection with corresponding CN Application No. 201510714579.2 dated Oct. 13, 2017.

* cited by examiner

FILTER ASSEMBLY AND METHOD

CROSS-REFERENCE TO RELATED APPLICATIONS

This application claims priority to U.S. Provisional Application No. 62/069,946, which was filed on 29 Oct. 2014, and the entire disclosure of which is incorporated by reference.

FIELD

Embodiments of the subject matter disclosed herein relate to electronic filter assemblies, such as inverters, transformers, or the like.

BACKGROUND

Some electronic filter assemblies used for multi-phase electric currents include transformers, inductors, and the like. These assemblies can include vertically oriented and parallel ferrite limbs joined by horizontally oriented and parallel ferrite yokes. Conductive wires are wound around the vertical limbs to form the assemblies. During operation, electric current is conducted by some of these windings to induce magnetic flux in the ferrite limbs and yokes. This flux can be conducted through the yokes to other limbs, where the flux can induce another current in the wires. This other current can be a current that is filtered or otherwise transformed by the assembly before being conducted to one or more loads.

Due to the vertical orientation of the limbs, these types of filter assemblies may not be magnetically symmetric. For example, different magnetic fluxes induced in different limbs may be conducted different distances and/or along different paths. This can cause an uneven temperature or heating distribution in the limbs and yokes, which may lead to decreased service life or damage to the filter assemblies. Additionally, because the yokes typically are relatively large in order to be coupled with the limbs, the filter assemblies may be large and heavy.

The asymmetric filter assemblies also can cause significant increases in impedance and/or leakage of magnetic flux from the assemblies during common mode operation. For example, when the asymmetric filter assemblies are used to conduct a common mode magnetic flux, the common mode flux may not be able to be conducted through the yokes to the other limbs. As a result, impedance of the filter assemblies increase significantly and/or the common mode flux leaks from the limbs and yokes of the filter assemblies.

BRIEF DESCRIPTION

In one embodiment, an electronic filter assembly includes a magnetically conductive annular body extending around a center axis, a first set of magnetically conductive prongs radially extending from the center axis toward the annular body, and conductive windings extending around the prongs in the first set.

In another embodiment, a method (e.g., for forming an electronic filter assembly) includes forming an electronic filter assembly having a magnetically conductive annular body extending around a center axis and a first set of magnetically conductive prongs radially extending from the center axis toward the annular body. The annular body and the prongs can be formed by coupling plural layers of magnetically conductive bodies together. The prongs are configured to receive conductive windings extending around the prongs to form the electronic filter assembly.

In another embodiment, another electronic filter assembly includes a magnetically conductive annular body extending around a center axis, a first set of magnetically conductive prongs radially extending from the center axis toward the annular body, and a second set of magnetically conductive prongs radially extending from the center axis toward the annular body. The first set of the magnetically conductive prongs are configured to magnetically conduct a magnetic flux during a differential mode of operation of the filter assembly and the second set of the magnetically conductive prongs are configured to magnetically conduct the magnetic flux during a common mode of operation of the filter assembly.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

One or more embodiments of the assemblies and methods described herein provide symmetric common-mode structures for filter assemblies, such as for filters used in power-electronics inverters. The assemblies described herein can be relatively easy to manufacture and can provide compact, light-weight, and/or lower cost filters relative to some known core-type filters.

Figure 1:
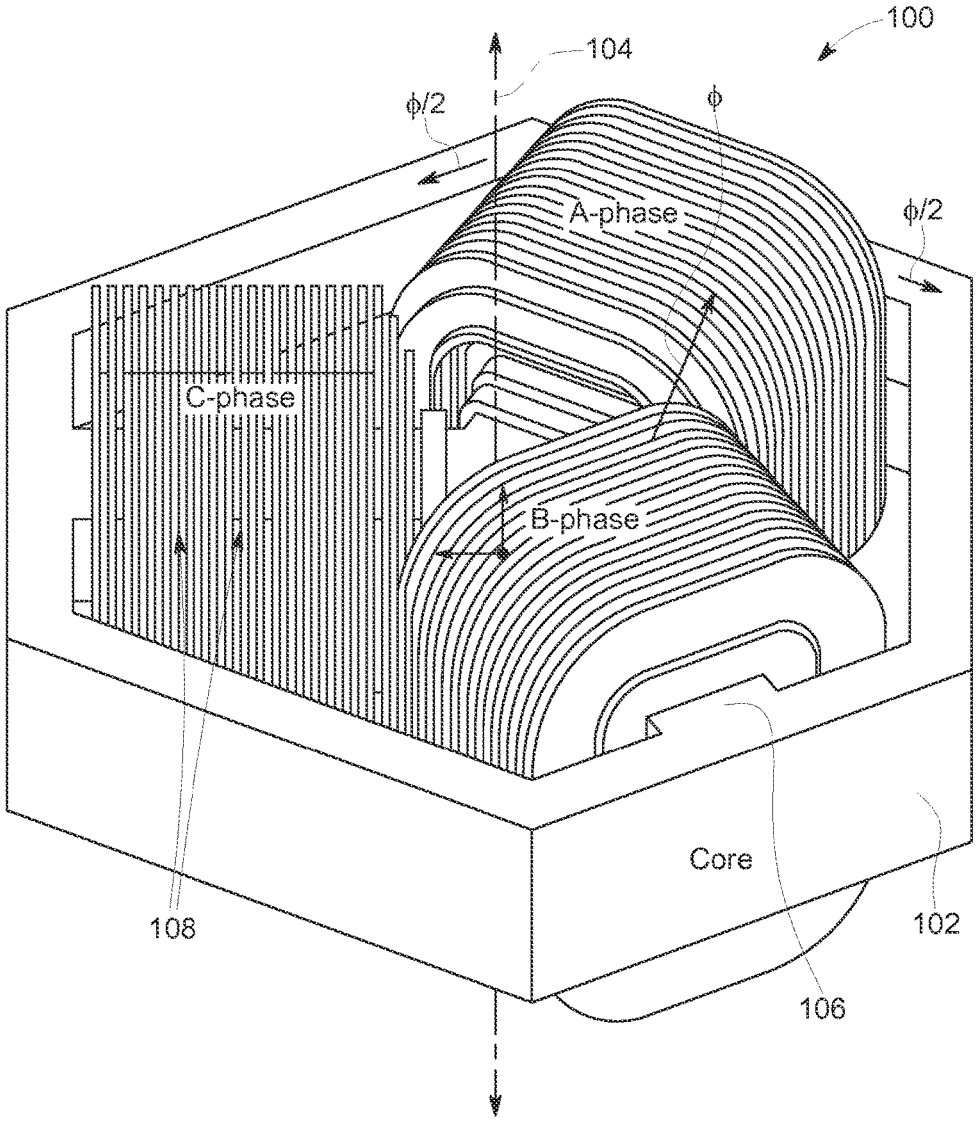
FIG. 1 is a perspective view of a symmetric filter assembly according to one embodiment.
Figure 2:
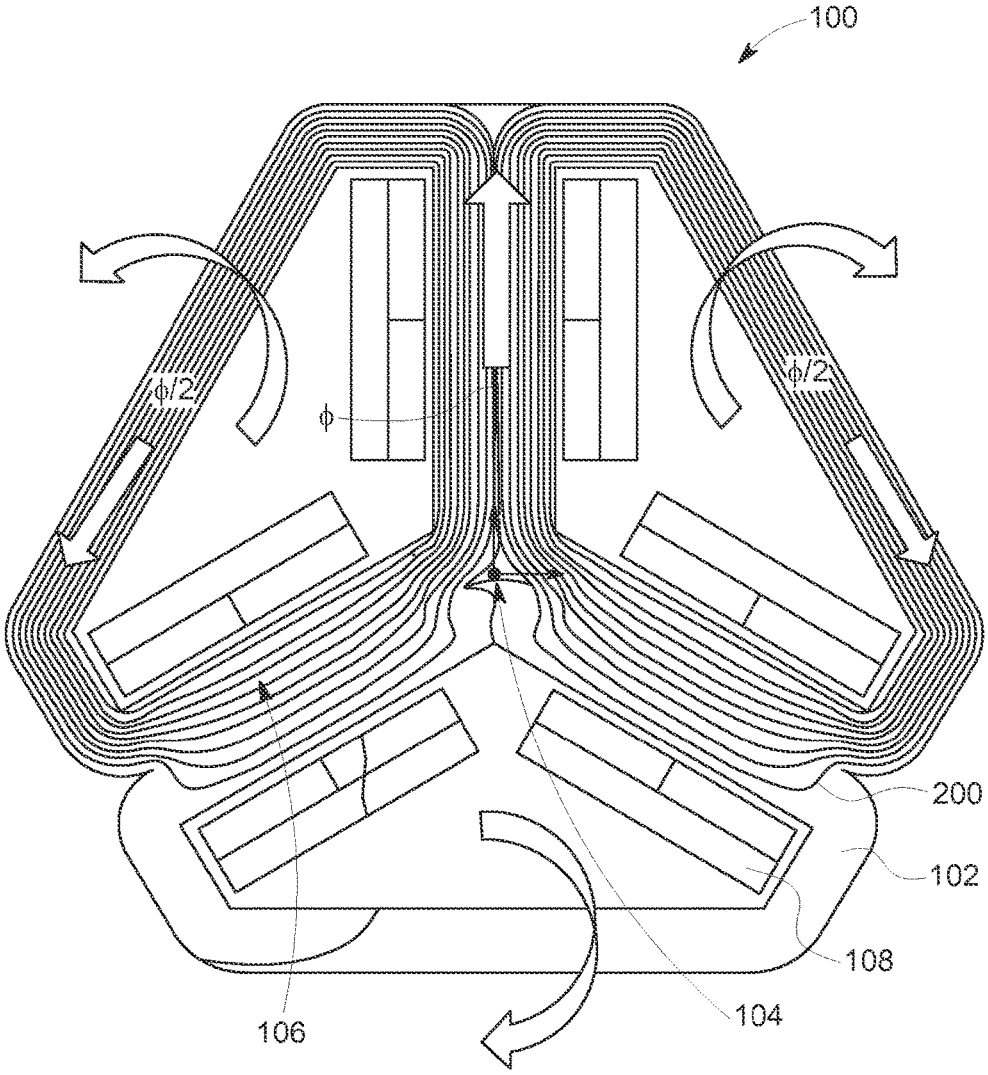
FIG. 2 is a schematic diagram of the filter assembly shown in FIG. 1.

FIG. 1 is a perspective view of a symmetric filter assembly 100 according to one embodiment. FIG. 2 is a schematic diagram of the filter assembly 100 shown in FIG. 1. FIG. 2 illustrates the flow of magnetic flux through the filter assembly 100. The filter assembly 100 includes an annular yoke or core body 102 that extends around (e.g., encircles) a center axis 104. The core body 102 may have a non-circular shape as shown in FIG. 1, may have a circular shape, or may have another shape. The core body 102 can be formed from a magnetically conductive material, such as a ferrite material.

The filter assembly 100 also includes plural prongs 106 that radially extend along directions extending from the center axis 104 toward the core body 102. The prongs 106 also can be formed from a magnetically conductive material, such as a ferrite material. The prongs 106 can be coupled with the core body 102 and with each other, as shown in FIG. 1, or may be separated from the core body 102 and/or each other by one or more separation gaps, as described below.

The prongs 106 may be symmetrically disposed around the center axis 104. For example, the prongs 106 may be separated from each other by $$\frac{360}{n}$$

degrees, by $$\frac{2\pi}{n}$$

radians, or by another distance, where n represents the number of prongs 106. In the illustrated embodiment, three prongs 106 are included, but alternatively, another number of prongs 106 may be provided. The prongs 106 are at least partially surrounded by conductive windings 108. The conductive windings 108 can conduct different phases of an electric current to induce magnetic fluxes in the prongs 106. For example, the conductive windings 108 around a first prong 106 can electrically conduct a first phase (e.g., "A-phase" in FIG. 1) of an alternating current, a different, second prong 106 can electrically conduct a different, second phase (e.g., "B-phase" in FIG. 1) of the same alternating current, and a different, third prong 106 can electrically conduct a different, third phase (e.g., "C-phase" in FIG. 1) of the same alternating current.

During conduction of a first phase of the electric current through the conductive windings 108 extending around a prong 106 (e.g., the A-phase and the first prong 106 as shown in FIG. 1), a magnetic flux (Φ) is induced in the prong 106. FIG. 2 illustrates several flux lines 200 representative of the magnetic flux (Φ) in the filter assembly 100. The spacing between the flux lines 200 can indicate the density of the magnetic flux (Φ), such as where closer lines 200 represent increased flux density relative to lines 200 that are farther apart. As the flux (Φ) is conducted along the prong 106, the flux (Φ) can be divided into partial fluxes (e.g., $$\frac{\phi}{2})$$

and be conducted through the core body 102. Other prongs 106 can conduct other magnetic fluxes (Φ) into the core body 102 in similar manner as what is shown in FIG. 2 for a single prong 106.

The windings 108 around each prong 106 can represent different sets of conductive windings. For example, the conductive windings 108 around one prong 106 can represent a first winding and a second winding of conductive material (e.g., wires), with the first winding and the second windings being separate from each other and not conductively coupled with each other. One of these windings can conduct a current to induce the magnetic flux (Φ) in the prong 106. The other winding may conduct a current that is generated based on the magnetic flux (Φ) being conducted through the same prong 106. For example, a current may be induced in the second winding by the magnetic flux (Φ). The current that is conducted through the first winding to induce the magnetic flux (Φ) can be referred to as an input or incoming current and the current that is induced in the second winding from the magnetic flux (Φ) can be referred to as an output or outgoing current. The filter assembly 100 may receive electric current into the first windings around the prongs 106 and remove portions of this current (e.g., by filtering out spikes or sudden increases in the current) by inducing the magnetic flux (Φ) in the prongs 106 and core body 102 of the filter assembly 100 and then inducing the output current in the second windings from the magnetic flux (Φ). Optionally, the filter assembly 100 can be used as a transformer, inductor, or the like, that increases, decreases, or otherwise changes a voltage or other magnitude of the current that is conducted into the first windings to the output current that is induced in the second windings.

As shown in FIGS. 1 and 2, the prongs 106 and core body 102 of the filter assembly 100 are symmetrically disposed about the center axis 104. This symmetric arrangement of the filter assembly 100 can provide for a more uniform temperature distribution throughout the filter assembly 100. For example, during conduction of larger currents through the conductive windings 108, relatively large magnetic fluxes (Φ) can be induced and conducted through the prongs 106 and core body 102. These fluxes (Φ) can significantly increase the temperature of the prongs 106 and core body 102. Because the prongs 106 and core body 102 form a symmetric shape about the center axis 104, the distribution of temperature increases can be evenly distributed throughout the prongs 106 and core body 102. If the prongs 106 were not evenly spaced about the center axis 104 and/or if the core body 102 has another, non-symmetric shape around the center axis 104, then the temperature increase in one or more portions of the filter assembly 100 may be significantly greater than the temperature increases in one or more other portions of the filter assembly 100. Such localized heating can increase the wear and tear, and/or increase the probability of failure, at or near the portions having the larger temperature increases. By evenly distributing the temperature increases, the filter assembly 100 can have a longer service life before repair and/or replacement is needed relative to an asymmetric filter assembly.

The symmetric shape of the filter assembly 100 also can reduce the weight of the filter assembly 100 relative to asymmetric shapes. Asymmetric shapes of filters can involve extra material that is not efficiently used to conduct magnetic flux (Φ) in the ferrite materials of the filters. The symmetric shape of the filter assembly 100 can reduce the amount of extra ferrite material that is included in the prongs 106 and/or core body 102 without sacrificing the conduction of magnetic flux (Φ) in the filter assembly 100 relative to heavier, asymmetric filters. The reduced amount of materials also may reduce the cost and/or size of the filter assembly 100 relative to asymmetric filters.

Figure 3:
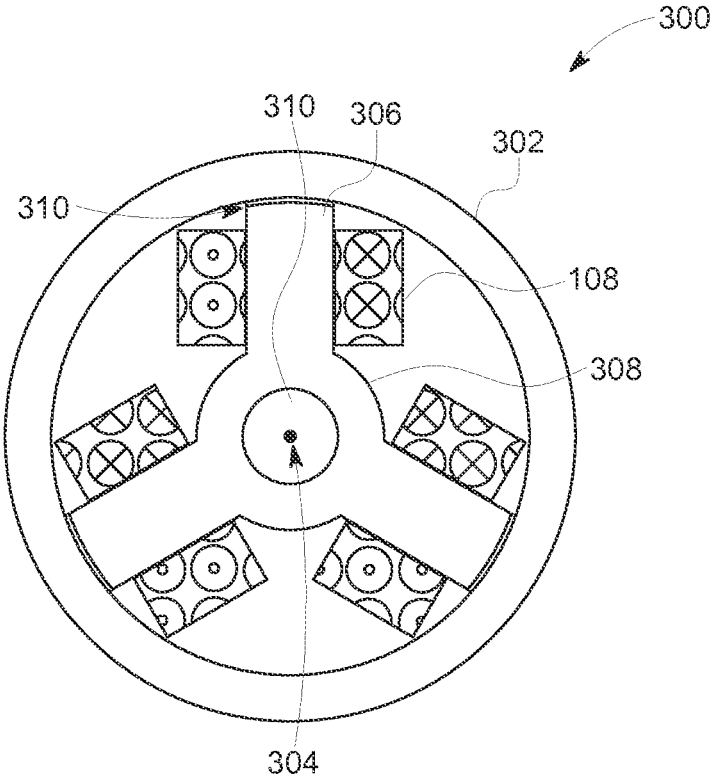
FIG. 3 illustrates another filter assembly according to another embodiment.
Figure 4:
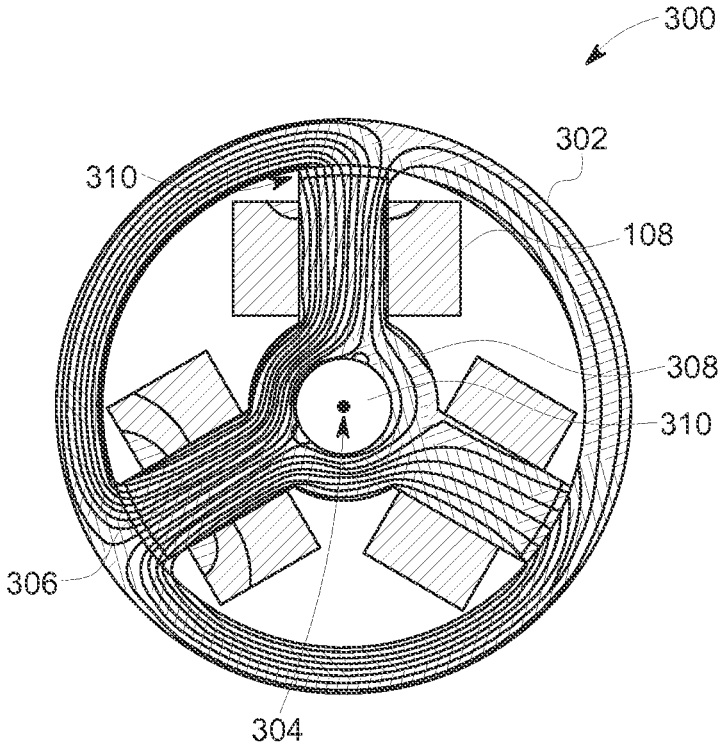
FIG. 4 is a schematic diagram of the filter assembly shown in FIG. 3.

FIG. 3 illustrates another filter assembly 300 according to another embodiment. Similar to the filter assembly 100 shown in FIGS. 1 and 2, the filter assembly 300 includes an annular yoke or core body 302 that extends around (e.g., encircles) a center axis 304. FIG. 4 is a schematic diagram of the filter assembly 300 shown in FIG. 3. FIG. 4 illustrates the flow of magnetic flux through the filter assembly 300. The center axis 304 is shown as a point in FIG. 3 because the center axis 304 is oriented perpendicular to the plane of FIG. 3. The core body 302 may have a circular shape as shown in FIG. 3, may have a non-circular shape, or may have another shape. The core body 302 can be formed from a magnetically conductive material, such as a ferrite material.

The filter assembly 300 also includes plural prongs 306 that radially extend along directions extending from the center axis 304 toward the core body 302. In contrast to the prongs 106 shown in FIG. 1 that meet at the center axis 104 shown in FIGS. 1 and 2, the prongs 306 shown in FIG. 3 do not meet at the center axis 304. Instead, the prongs 306 extend to an inner annular section 308 of the filter assembly 300 that extends around or encircles an air gap or separation gap 310. The inner annular section 308 may be formed from the same or similar material as the core body 302 and/or prongs 306. The center axis 304 is disposed within the gap 310 inside the inner annular section 308. The prongs 306 are coupled with the inner annular section 308 such the prongs 306 and inner annular section 308 are continuous (e.g., not separated by a gap). Alternatively, one or more gaps may be disposed between the prongs 306 and the inner annular section 308.

Also in contrast to the filter assembly 100 shown in FIGS. 1 and 2, the filter assembly 300 includes separation gaps 310 between the prongs 306 and the core body 302. The separation gaps 310 may be air gaps or may be spaces that are completely or at least partially filled with a material, such as a dielectric material. The prongs 306 also can be formed from a magnetically conductive material, such as a ferrite material.

Similar to the prongs 106 shown in FIGS. 1 and 2, the prongs 306 may be symmetrically disposed around the center axis 304. In the illustrated embodiment, three prongs 306 are included, but alternatively, another number of prongs 306 may be provided. The prongs 306 are at least partially surrounded by conductive windings 108 similar or identical to the prongs 106 of the filter assembly 100 shown in FIGS. 1 and 2. The conductive windings 108 can conduct different phases of an electric current to induce magnetic fluxes in the prongs 306, similar to as described above.

During conduction of a first phase of the electric current through the conductive windings 108 extending around a first prong 306, a magnetic flux (Φ) may be induced in the first prong 306. As the flux (Φ) is conducted along the first prong 306, the flux (Φ) can be divided into partial fluxes (e.g., $$\frac{\phi}{2})$$

and be conducted across the separation gap 310 and into the core body 302. Other prongs 306 can conduct other magnetic fluxes (Φ) into the core body 302 in similar manner. Several magnetic flux lines 200 shown in FIG. 4 illustrate the density of magnetic flux (Φ) being conducted and/or induced in the prongs 306 and core body 302.

As shown in FIG. 3, the prongs 306 and core body 302 of the filter assembly 300 are symmetrically disposed about the center axis 304. This symmetric arrangement of the filter assembly 300 can provide for a more uniform temperature distribution throughout the filter assembly 300, and/or reduced weight, cost, and/or size of the filter assembly 300 relative to asymmetric filters.

Figure 5:
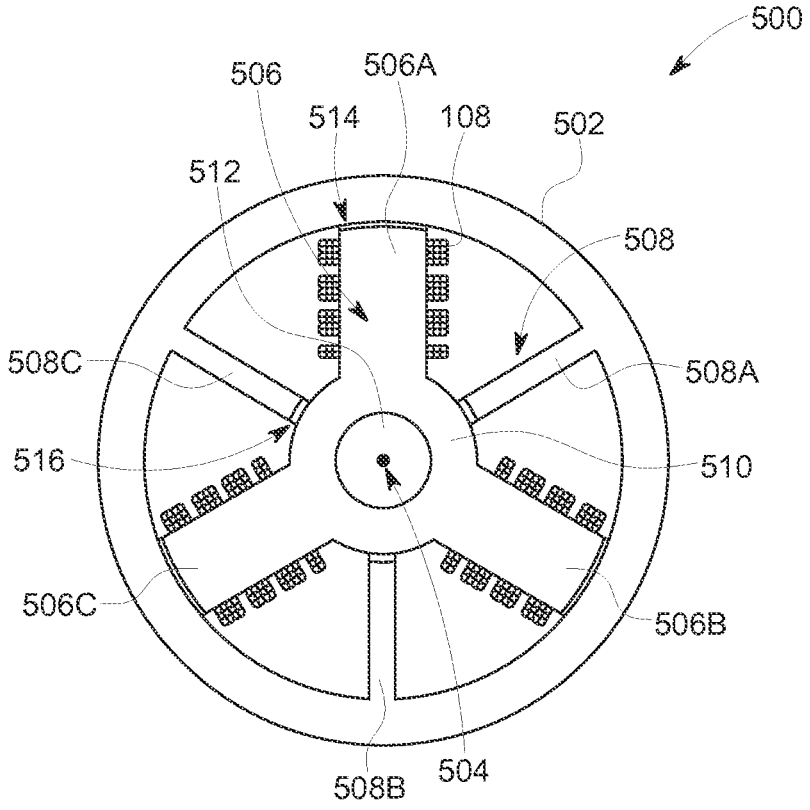
FIG. 5 illustrates a cross-sectional view of a filter assembly according to another embodiment.

FIG. 5 illustrates a cross-sectional view of a filter assembly 500 according to another embodiment. Similar to the filter assemblies 100, 300 shown in FIGS. 1 through 4, the filter assembly 500 includes an annular yoke or core body 502 that extends around (e.g., encircles) a center axis 504. The center axis 504 is shown as a point in FIG. 5 because the center axis 504 is oriented perpendicular to the plane of FIG. 5. The core body 502 may have a circular shape as shown in FIG. 5, may have a non-circular shape, or may have another shape. The core body 502 can be formed from a magnetically conductive material, such as a ferrite material.

Similar to the filter assemblies 100, 300, the filter assembly 500 also includes several prongs that radially extend along directions extending from the center axis 504 toward the core body 502. In contrast to the filter assemblies 100, 300, the filter assembly 500 includes plural sets of the prongs. A first set of the prongs includes differential mode prongs 506 (e.g., prongs 506A-C) and another set of the prongs includes common mode prongs 508 (e.g., prongs 508A-C). While three prongs 506 and three prongs 508 are shown, alternatively, one or more of the differential mode prongs 506 and/or the common mode prongs 508 may include a lesser or greater number of prongs 506, 508. As shown in FIG. 5, the differential mode prongs 506 may be larger than the common mode prongs 508, such as by a cross-sectional diameter, perimeter, area, or other measurement of the differential mode prongs 506 being greater than a corresponding cross-sectional diameter, perimeter, area, or other measurement of the common mode prongs 508. The prongs 506, 508 also can be formed from a magnetically conductive material, such as a ferrite material.

Similar to the prongs 306 of the filter assembly 300 shown in FIG. 3, the prongs 506 shown in FIG. 5 do not meet at the center axis 504. The prongs 506 may extend to an inner annular section 510 of the filter assembly 500, which can be formed from the same or similar material as the prongs 506 and/or the core body 502. The inner annular section 510 may be continuous with the prongs 506 such that no gap or separation exists between the prongs 506 and the inner annular section 510, similar to the prongs 306 and the inner annular section 308 shown in FIG. 3. Alternatively, one or more gaps may be disposed between the prongs 506 and the inner annular section 510. The inner annular section 510 extends around or encircles an air gap or separation gap 512. The center axis 504 is disposed within the gap 512 inside the inner annular section 510.

Separation gaps 514 may be disposed between the differential mode prongs 506 and the core body 502. The separation gaps 514 may be air gaps or may be spaces that are completely or at least partially filled with a material, such as a dielectric material. Alternatively, the differential mode prongs 506 can be coupled with or continuous with the core body 502 such that no gaps exist between the differential mode prongs 506 and the core body 502.

The common mode prongs 508 may be separated from the inner annular section 510 of the filter assembly 500 by separation gaps 516. The separation gaps 516 may be air gaps or may be spaces that are completely or partially filled with a material, such as a dielectric material. Alternatively, the common mode prongs 508 can be coupled with or continuous with the inner annular section 510 such that no gaps exist between the common mode prongs 508 and the inner annular section 510.

Similar to the prongs 106, 306 shown in FIGS. 1 through 4, the prongs 506 and the prongs 508 may be symmetrically disposed around the center axis 504. In the illustrated embodiment, each of the common mode prongs 508 is disposed between two differential mode prongs 506 and each of the differential mode prongs 506 is disposed between two common mode prongs 508. For example, the order of the prongs 506, 508 may alternate along a clockwise or counter-clockwise path around the center axis 504.

The differential mode prongs 506 are at least partially surrounded by conductive windings 108 similar or identical to the prongs 106, 306 of the filter assemblies 100, 300 shown in FIGS. 1 through 4. The conductive windings 108 can conduct different phases of an electric current to induce magnetic fluxes in the prongs 506 and/or to conduct output currents induced by the magnetic fluxes, similar to as described above. For example, the windings 108 around the prong 506A can conduct a first phase of an alternating current to induce a first magnetic flux ($\Phi_1$) in the prong 506A, the windings 108 around the prong 506B can conduct a second phase of the alternating current to induce a second magnetic flux ($\Phi_2$) in the prong 506B, and the windings 108 around the prong 506C can conduct a third phase of the alternating current to induce a third magnetic flux ($\Phi_3$) in the prong 506C. The windings 108 also can conduct an output current that is induced in the windings 108 by the magnetic fluxes ($\Phi_1$, $\Phi_2$, $\Phi_3$)

During different modes of operation of the filter assembly 500, different magnetic fluxes ($\Phi$) can be induced in the prongs 506 and/or 508. For example, during a differential mode operation of the filter assembly 500, magnetic fluxes ($\Phi$) may be induced in the differential mode prongs 506 and conducted by the differential mode prongs 506 to the core body 502 and/or other prongs 506, but may not be induced in and/or conducted to the common mode prongs 508. During a common mode operation of the filter assembly 500, magnetic fluxes ($\Phi$) may be induced and/or conducted by both the differential mode prongs 506 and the common mode prongs 508.

Figure 6:
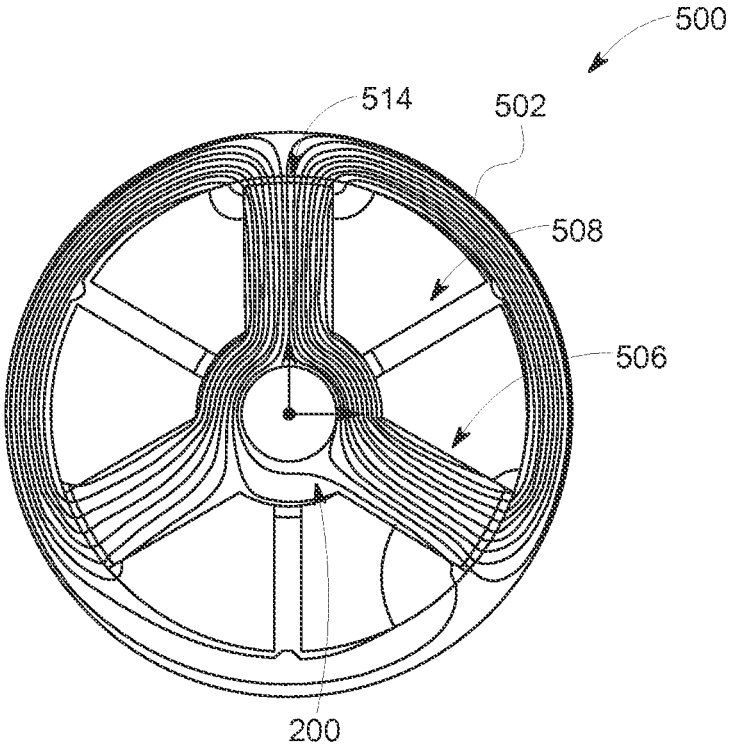
FIG. 6 schematically illustrates conduction of magnetic flux (Φ) in the filter assembly during a differential mode operation of the filter assembly according to one embodiment.

FIG. 6 schematically illustrates conduction of magnetic flux ($\Phi$) in the filter assembly 500 during a differential mode operation of the filter assembly 500 according to one embodiment. As shown by the flux lines 200 representative of the magnetic flux ($\Phi$) in the prongs and core body of the filter assembly 500, the magnetic flux ($\Phi$) is induced in the differential mode prongs 506 but not in the common mode prongs 508 when the current is conducted through the windings 108 to the filter assembly 500 in a differential mode. This flux ($\Phi$) is relatively dense in the differential mode prongs 506 and can be conducted across the gaps 514 into the core body 502. As described above, parts of the windings 108 may conduct the differential mode current to generate the magnetic flux ($\Phi$), while separate other parts of the windings 108 may conduct an output current that is induced by the magnetic flux ($\Phi$) out of the filter assembly 500.

Figure 7:
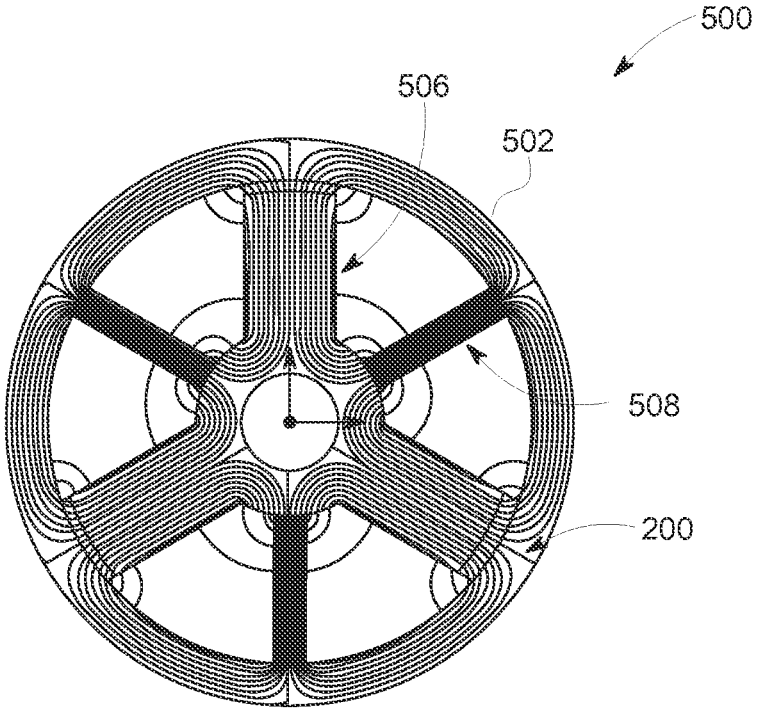
FIG. 7 schematically illustrates conduction of magnetic flux (Φ) in the filter assembly during a common mode operation of the filter assembly according to one embodiment.

FIG. 7 schematically illustrates conduction of magnetic flux ($\Phi$) in the filter assembly 500 during a common mode operation of the filter assembly 500 according to one embodiment. As shown by the flux lines 200 representative of the magnetic flux ($\Phi$) in the prongs and core body of the filter assembly 500, the magnetic flux ($\Phi$) is induced in the differential mode prongs 506 and in the common mode prongs 508 when the current is conducted through the windings 108 to the filter assembly 500 in a common mode. This flux ($\Phi$) is induced in the common mode prongs 508 even though the windings 108 that conduct the current that induces the magnetic flux ($\Phi$) do not extend around the common mode prongs 508 in one embodiment.

As described above, the prongs 506, 508 and core body 508 of the filter assembly 500 are symmetrically disposed about the center axis 504. This symmetric arrangement of the filter assembly 500 can provide for a more uniform temperature distribution throughout the filter assembly 500, and/or reduced weight, cost, and/or size of the filter assembly 500 relative to asymmetric filters. Additionally, the common mode prongs 508 can be provided to conduct the magnetic flux ($\Phi$) induced by common mode current through the filter assembly 500. By conducting the magnetic flux ($\Phi$) induced by both differential and common modes of operation, very little or no magnetic flux ($\Phi$) may leak out of the filter assembly 500. Instead, substantially all or all of the magnetic flux ($\Phi$) may be used to induce the output current that is conducted out of the filter assembly 500 by the windings 108.

In one aspect, the common mode prongs 508 provide paths for common mode flux only. These prongs 508 can be saturated with magnetic flux and/or the symmetric locations of the prongs 508 can cancel some of the flux being carried by the prongs 508 such that the prongs 508 do not contribute any inductance to the filter assembly 500. While in case of zero-sequence flux (or common mode flux), common mode flux cannot complete a path from the prongs 506 and therefore can be conducted through the prongs 508.

For example, in a situation where an R-phase of magnetic flux is maximum (e.g., ($\Phi_m$), the Y-phase and B-phase of the magnetic flux can each be $$\frac{\phi_m}{2}.$$

The flux induced in any of the prongs 506 can be conducted along a path from the other two prongs 506 with very little flux being conducted through the common mode prongs 508. At the time of a zero-phase sequence flux (e.g., a common mode flux or common mode operation, where the magnetic flux is identical in phase and magnitude), the flux cannot be conducted along a path through the differential mode prongs 506. Because the common mode prongs 508 are symmetrically positioned around the center axis 504, this common mode flux can be conducted through the common mode prongs 508 and high inductance provided to this common mode flux.

One or more of the filter assemblies described herein can be formed according to a laminate assembly method. Such a method can include combining multiple layers of material (e.g., ferrite material) used to form the core and prongs of the filter assembly. The layers can be combined by placing an adhesive material between abutting layers, by melting, welding, or otherwise fusing abutting layers together, or the like, until the core body and prongs are formed. The conductive windings can then be wound around the prongs, as described herein.

Figure 10:
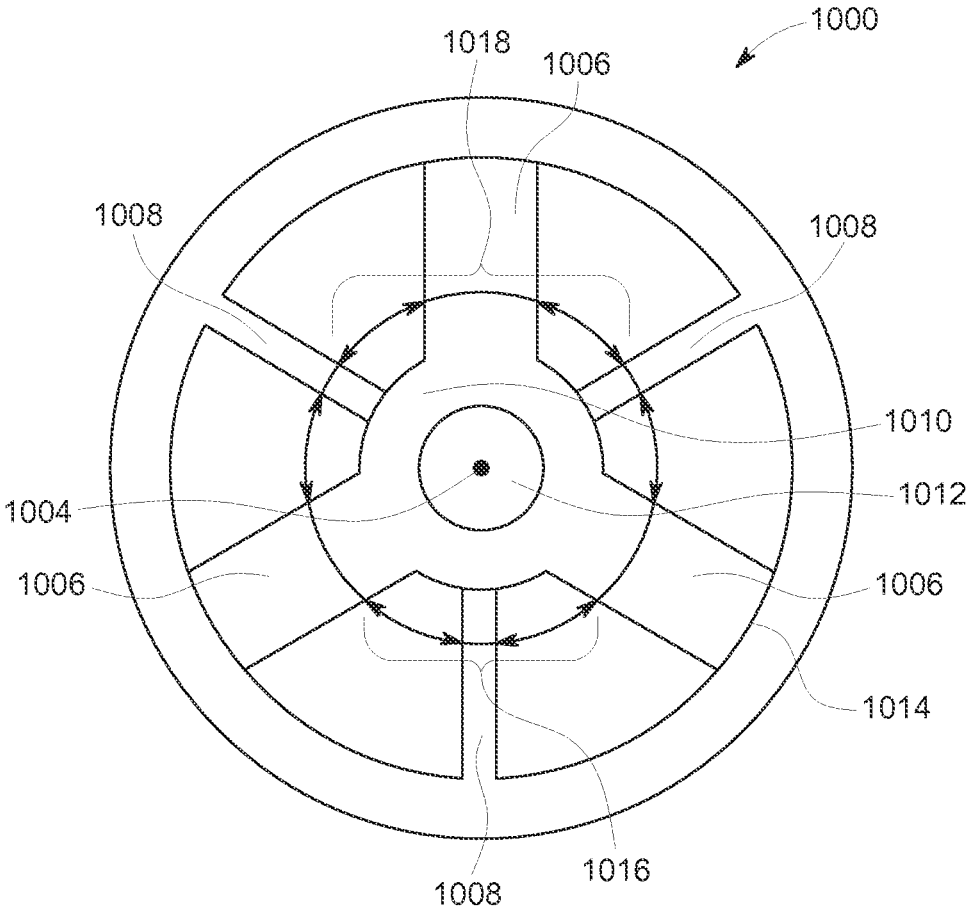
FIG. 10 illustrates a cross-sectional view of a filter assembly according to one embodiment.

FIG. 10 illustrates a cross-sectional view of a filter assembly 1000 according to one embodiment. The filter assembly 1000 can represent one or more of the filter assemblies described herein, such as the filter assembly 100, 300, and/or 500. The filter assembly 1000 includes an annular yoke or core body 1002 that extends around (e.g., encircles) a center axis 1004. The center axis 1004 is shown as a point in FIG. 10 because the center axis 1004 is oriented perpendicular to the plane of FIG. 10. The filter assembly 1000 also includes several prongs that radially extend along directions extending from the center axis 1004 toward the core body 1002. In the illustrated embodiment, the filter assembly 1000 includes a first set of prongs 1006 (e.g., differential mode prongs) and a second set of prongs 1008 (e.g., common mode prongs). Alternatively, the filter assembly 1000 may include the prongs 1006 but not the prongs 1008, or may include the prongs 1008 but not the prongs 1006.

The prongs 1006 do not meet at the center axis 1004. The prongs 1006 may extend to an inner annular section 1010 of the filter assembly 1000. The inner annular section 1010 may be continuous with the prongs 1006 such that no gap or separation exists between the prongs 1006 and the inner annular section 1010. Alternatively, one or more gaps may be disposed between the prongs 1006 and the inner annular section 1010. The inner annular section 1010 extends around or encircles an air gap or separation gap 1012. The center axis 1004 is disposed within the gap 1012 inside the inner annular section 1010. Separation gaps 1014 may be disposed between the prongs 1006 and the core body 1002. Alternatively, the prongs 1006 can be coupled with or continuous with the core body 1002 such that no gaps exist between the prongs 1006 and the core body 1002. The prongs 1008 may be separated from the inner annular section 1008 by separation gaps, similar to the gaps 516 shown in FIG. 5. Alternatively, the prongs 1008 can be coupled with or continuous with the inner annular section 1010 such that no gaps exist between the common mode prongs 1008 and the inner annular section 1010. The prongs 1006 may be at least partially surrounded by conductive windings similar to as described herein for other assemblies.

The prongs 1006 and the prongs 1008 may be symmetrically disposed around the center axis 1004. Arcs 1016 having the same length may extend between neighboring prongs 1006 of the first set of prongs 1006. Arcs 1018 having the same length may extend between neighboring prongs 1008 of the second set of prongs 1008. Only one of each of the arcs 1016, 1018 is shown in FIG. 10 for purposes of clarity. These arcs 1016, 1018 may extend along paths defined by circumferences of one or more circles having a center that is coextensive (e.g., the same as) the center axis 1004. In one embodiment, the arcs 1016, 1018 may extend along a path defined by the circumference of the same circle having a center that is the same as the center axis 1004. The length of the arcs 1016 may all be the same and the length of the arcs 1018 may all be the same. The length of the arcs 1016 may be the same as the length of the arcs 1018 in one embodiment. Alternatively, the length of the arcs 1016 may differ from the length of the arcs 1018 (e.g., where there are more prongs 1006 than prongs 1008 or more prongs 1008 than prongs 1006).

The prongs 1006 are symmetrically disposed around the center axis 1004 by being spaced apart from each other by the same distances (e.g., the arcs 1016) that extend around the center axis 1004. The prongs 1008 are symmetrically disposed around the center axis 1004 by being spaced apart from each other by the same distances (e.g., the arcs 1018) that extend around the center axis 1004.

Figure 8:
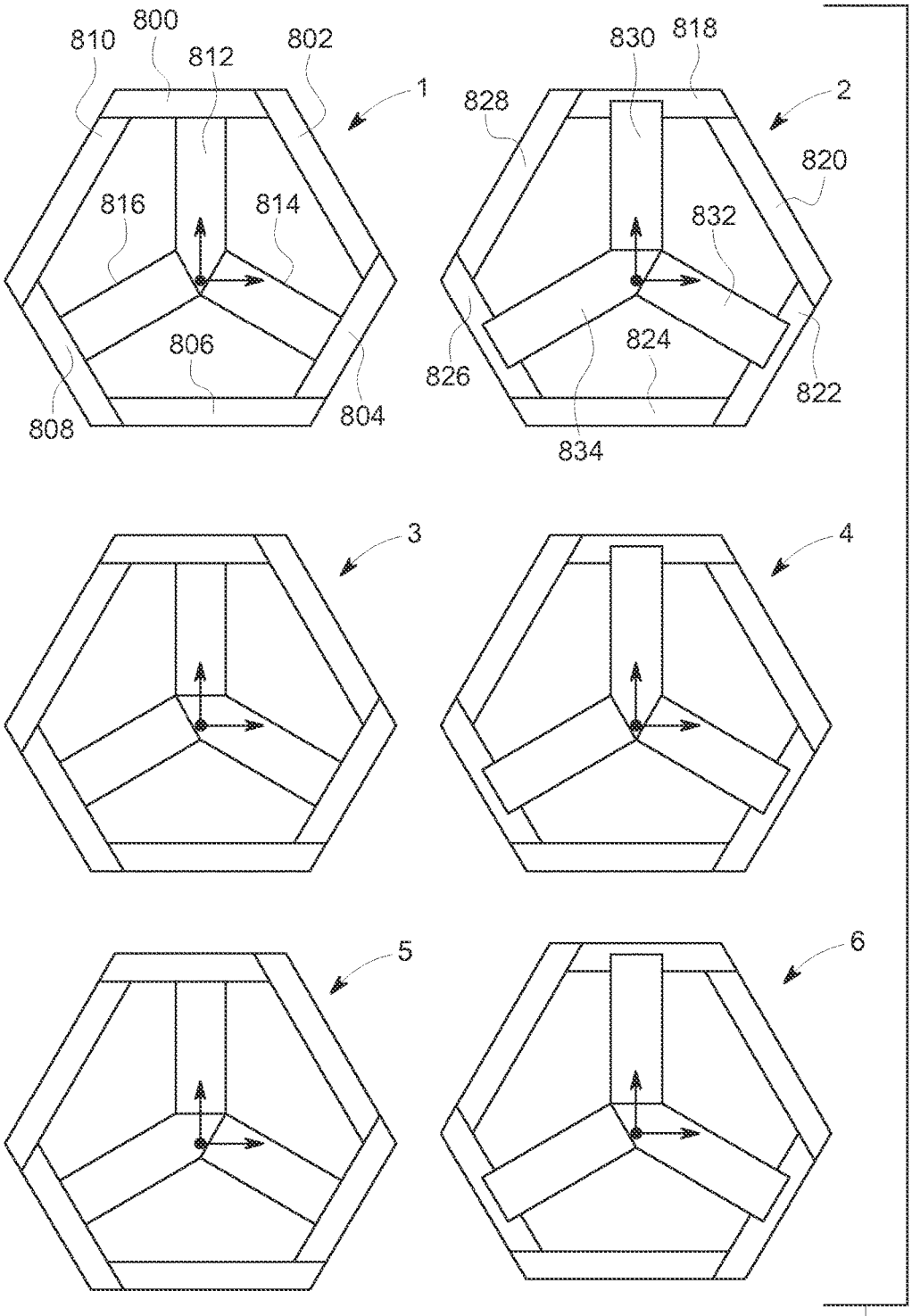
FIG. 8 illustrates several layers of material that may be combined to form the filter assembly shown in FIG. 1 according to one embodiment.

FIG. 8 illustrates several layers 1-6 of material that may be combined to form the filter assembly 100 shown in FIG. 1 according to one embodiment. While the description of the fabrication method focuses on the filter assembly 100, optionally, this same method can be used to form one or more other filter assemblies 300, 500 described herein.

In one embodiment, the layers can be formed from several separate bodies of ferrite material or another magnetically conductive material. These bodies can be coupled with each other, such as by using an adhesive, by welding, fusing, or otherwise connecting the bodies. The bodies used to form the same part of the filter assembly 100 in different layers 1-6 can be differently shaped.

For example, the bodies 800, 802, 804, 806, 808, 810 in layer 1 form the core body 102. These bodies differ in shape from the bodies 818, 820, 822, 824, 826, 828 in the layer 2 that form the corresponding portions of the core body 102. Additionally, the bodies 812, 814, 816 that form parts of the prongs 106 in the layer 1 can be differently shaped from the bodies 830, 832, 834 in the layer 2. As shown in FIG. 8, other layers 3-6 can have differently shaped bodies that form different parts of the core body 102 and/or prongs 106. These different layers 1-6 with the differently shaped bodies can be coupled together to form the core body 102 and the prongs 106.

Figure 9:
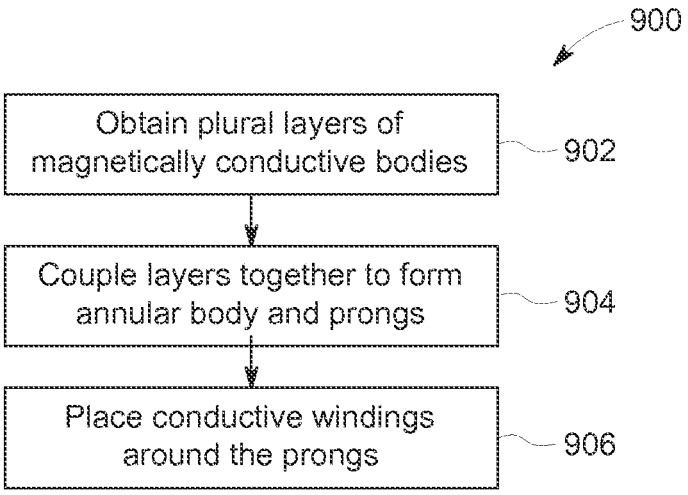
FIG. 9 illustrates a flowchart of a method for forming an electronic filter assembly according to one embodiment.

FIG. 9 illustrates a flowchart of a method 900 for forming an electronic filter assembly according to one embodiment. The method 900 may be used to form one or more of the filter assemblies described herein. At 902, plural layers of magnetically conductive bodies are obtained. These layers may be cut or otherwise obtained from a larger body of a magnetically conductive material. For example, the smaller bodies shown in FIG. 8 may be cut from a magnetically conductive material and then joined together by adhesives, welding, fusing, or the like, to form the multiple layers 1-6 shown in FIG. 8. At 904, the layers are coupled together to form an annular body with prongs. For example, the layers 1-6 shown in FIG. 8 may be joined together using adhesive, welding, fusing, or the like, to form one or more of the annular bodies and prongs shown and described herein. At 906, conductive windings are placed around the prongs to form an electronic filter assembly. For example, the windings 108 may be wound around the prongs 106, 306, 506 to form one or more of the filter assemblies described herein.

In one embodiment, an electronic filter assembly includes a magnetically conductive annular body extending around a center axis, a first set of magnetically conductive prongs radially extending from the center axis toward the annular body, and conductive windings extending around the prongs in the first set.

In one aspect, the first set of the magnetically conductive prongs is configured to magnetically conduct a magnetic flux to the annular body. The magnetic flux can be induced in the first set of the magnetically conductive prongs by an electric current being conducted through the conductive windings.

In one aspect, the magnetically conductive prongs in the first set are symmetrically separated from each other around the center axis. For example, in a plane that is perpendicular to the center axis, the prongs in the first set may be separated from each other by arcs disposed in the same plane and extending from each prong to a neighboring prong in the first set, with the lengths of the arcs being the same between any two neighboring prongs of the prongs in the first set.

In one aspect, the prongs in the first set are separated from the annular body by one or more separation gaps.

In one aspect, the filter assembly also includes an inner annular section that extends around a gap through which the center axis passes. The prongs can extend from the inner annular section toward the annular body.

In one aspect, the filter assembly also includes a second set of magnetically conductive prongs radially extending from the center axis toward the annular body.

In one aspect, the prongs in the second set do not include any conductive windings extending around the prongs.

In one aspect, the annular body does not include any conductive windings extending around the annular body.

In one aspect, the first set of the magnetically conductive prongs is configured to magnetically conduct a magnetic flux during a differential mode of operation of the filter assembly and the second set of the magnetically conductive prongs are configured to magnetically conduct the magnetic flux during a common mode of operation of the filter assembly.

In one aspect, the magnetically conductive prongs in the first set are symmetrically separated from each other around the center axis and the magnetically conductive prongs in the second set are symmetrically separated from each other around the center axis. For example, in a plane that is perpendicular to the center axis, the prongs in the first set may be separated from each other by first arcs disposed in the same plane and extending from each prong to a neighboring prong in the first set and the prongs in the second set may be separated from each other by second arcs disposed in the same plane and extending from each prong to a neighboring prong, with the lengths of the first arcs being the same between any two neighboring prongs of the prongs in the first set and the lengths of the second arcs being the same between any two neighboring prongs of the prongs in the second set.

In one aspect, the magnetically conductive prongs in the first set and in the second set are configured to magnetically conduct the magnetic flux during conduction of a three phase electric current through the conductive windings.

In one aspect, the magnetically conductive prongs in the first set are separated from the annular body by separation gaps and the magnetically conductive prongs in the second set are connected with the annular body.

In one aspect, the annular body and the magnetically conductive prongs in the first set magnetically conduct the magnetic flux during a differential operational mode while the magnetically conductive prongs in the second set do not magnetically conduct the magnetic flux to prevent the magnetic flux from leaking outside of the annular body and the magnetically conductive prongs in the first set.

In another embodiment, a method (e.g., for forming an electronic filter assembly) includes forming an electronic filter assembly having a magnetically conductive annular body extending around a center axis and a first set of magnetically conductive prongs radially extending from the center axis toward the annular body. The annular body and the prongs can be formed by coupling plural layers of magnetically conductive bodies together. The prongs are configured to receive conductive windings extending around the prongs to form the electronic filter assembly.

In one aspect, the magnetically conductive bodies in the layers have different shapes.

In one aspect, the magnetically conductive bodies in the layers that form a common component of the annular body or the prongs have different shapes in different layers of the layers.

In another embodiment, another electronic filter assembly includes a magnetically conductive annular body extending around a center axis, a first set of magnetically conductive prongs radially extending from the center axis toward the annular body, and a second set of magnetically conductive prongs radially extending from the center axis toward the annular body. The first set of the magnetically conductive prongs are configured to magnetically conduct a magnetic flux during a differential mode of operation of the filter assembly and the second set of the magnetically conductive prongs are configured to magnetically conduct the magnetic flux during a common mode of operation of the filter assembly.

In one aspect, the magnetically conductive prongs in the first set are symmetrically separated from each other around the center axis and the magnetically conductive prongs in the second set are symmetrically separated from each other around the center axis.

In one aspect, the filter assembly also includes conductive windings extending around the magnetically conductive prongs in the first set.

In one aspect, the magnetically conductive prongs in the first set and in the second set are configured to magnetically conduct the magnetic flux during conduction of a three phase electric current through the conductive windings.

In one aspect, the magnetically conductive prongs in the first set are separated from the annular body by separation gaps and the magnetically conductive prongs in the second set are connected with the annular body.

In one aspect, the annular body and the magnetically conductive prongs magnetically conduct the magnetic flux during the differential mode and during the common mode to prevent the magnetic flux from leaking outside of the annular body and the magnetically conductive prongs.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

As used herein, a structure, limitation, or element that is "configured to" perform a task or operation is particularly structurally formed, constructed, programmed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, programming of the structure or element to perform the corresponding task or operation in a manner that is different from an "off-the-shelf" structure or element that is not programmed to perform the task or operation, and/or denotes structural requirements of any structure, limitation, or element that is described as being "configured to" perform the task or operation.

What is claimed is:

1. An electronic filter assembly comprising:

a magnetically conductive outer annular body extending around a center axis;

a magnetically conductive inner annular body extending around the center axis between the outer annular body and the center axis;

a first set of magnetically conductive prongs radially extending from the inner annular body toward the outer annular body, wherein the prongs in the first set are directly coupled with the inner annular body but are separated from the outer annular body by one or more first separation gaps;

a second set of magnetically conductive prongs radially extending from the outer annular body toward the inner annular body, wherein the prongs in the second set are directly coupled with the outer annular body but are separated from the inner annular body by one or more second separation gaps; and conductive windings extending around the prongs in the first set.

2. The electronic filter assembly of claim 1, wherein the first set of the magnetically conductive prongs is positioned relative to the conductive windings and the outer annular body such that the first set of the magnetically conductive prongs magnetically conduct a magnetic flux to the outer annular body, the magnetic flux being induced in the first set of the magnetically conductive prongs by an electric current being conducted through the conductive windings.

3. The electronic filter assembly of claim 1, wherein the magnetically conductive prongs in the first set are symmetrically separated from each other around the center axis.

4. The electronic filter assembly of claim 1, wherein the inner annular body extends around a gap through which the center axis passes such that the center axis does not pass through the inner annular body.

5. The electronic filter assembly of claim 1, wherein the prongs in the second set do not include any conductive windings extending around the prongs in the second set.

6. The electronic filter assembly of claim 1, wherein the first set of the magnetically conductive prongs is positioned such that the prongs in the first set magnetically conduct a magnetic flux during a differential mode of operation of the filter assembly and the second set of the magnetically conductive prongs is positioned such that the prongs in the second set magnetically conduct the magnetic flux during a common mode of operation of the filter assembly.

7. The electronic filter assembly of claim 1, wherein the magnetically conductive prongs in the first set are symmetrically separated from each other around the center axis and the magnetically conductive prongs in the second set are symmetrically separated from each other around the center axis.

8. The electronic filter assembly of claim 1, wherein the annular body and the magnetically conductive prongs in the first set are positioned to magnetically conduct the magnetic flux during a differential operational mode while the magnetically conductive prongs in the second set are positioned to not magnetically conduct the magnetic flux to prevent the magnetic flux from leaking outside of the annular body and the magnetically conductive prongs in the first set.

9. The electronic filter assembly of claim 1, wherein the outer annular body does not include any conductive windings extending around the outer annular body.

10. An electronic filter assembly comprising:

a magnetically conductive outer annular body extending around a center axis;

a magnetically conductive inner annular body extending around the center axis between the center axis and the outer annular body;

a first set of magnetically conductive prongs radially extending from the center axis toward the outer annular body, the prongs in the first set being separated from the outer annular body by first separation gaps but directly coupled with the inner annular body; and a second set of magnetically conductive prongs radially extending from the center axis toward the outer annular body, the prongs in the second set being directly coupled with the outer annular body but separated from the inner annular body by second separation gaps, and wherein the first set of the magnetically conductive prongs are positioned to magnetically conduct a magnetic flux during a differential mode of operation of the filter assembly and the second set of the magnetically conductive prongs are positioned to magnetically conduct the magnetic flux during a common mode of operation of the filter assembly.

11. The electronic filter assembly of claim 10, wherein the magnetically conductive prongs in the first set are symmetrically separated from each other around the center axis and the magnetically conductive prongs in the second set are symmetrically separated from each other around the center axis.

12. The electronic filter assembly of claim 10, wherein the magnetically conductive prongs in the first set and in the second set are positioned to magnetically conduct the magnetic flux during conduction of a three phase electric current through the conductive windings.

13. The electronic filter assembly of claim 10, wherein the outer annular body and the magnetically conductive prongs in the first set are positioned to magnetically conduct the magnetic flux during the differential mode and during the common mode to prevent the magnetic flux from leaking outside of the outer annular body and the magnetically conductive prongs.

14. An electronic filter assembly comprising:

a magnetically conductive outer annular body extending around a center axis;

a magnetically conductive inner annular body extending around the center axis between the outer annular body and the center axis;

a first set of magnetically conductive prongs radially extending from the center axis toward the outer annular body, the first set of prongs directly coupled with the inner annular body but not directly coupled with the outer annular body; and a second set of magnetically conductive prongs radially extending from the center axis toward the outer annular body, the second set of prongs directly coupled with the outer annular body but not directly coupled with the inner annular body, wherein the first set of the magnetically conductive prongs is positioned to magnetically conduct a magnetic flux during a differential mode of operation of the filter assembly and the second set of the magnetically conductive prongs is positioned to magnetically conduct the magnetic flux during a common mode of operation of the filter assembly; and wherein the magnetically conductive prongs in the first set are symmetrically separated from each other around the center axis and the magnetically conductive prongs in the second set are symmetrically separated from each other around the center axis.

15. The electronic filter assembly of claim 14, wherein the magnetically conductive prongs in the first set and in the second set are positioned to magnetically conduct the magnetic flux during conduction of a three phase electric current through the conductive windings.

16. The electronic filter assembly of claim 14, wherein the outer annular body and the magnetically conductive prongs are positioned to magnetically conduct the magnetic flux during the differential mode and during the common mode to prevent the magnetic flux from leaking outside of the annular body and the magnetically conductive prongs.

17. The electronic filter assembly of claim 1, wherein the one or more first separation gaps and the one or more second separation gaps are entirely filled with air.

18. The electronic filter assembly of claim 1, wherein the one or more first separation gaps and the one or more second separation gaps are entirely filled with a dielectric material other than air.

19. The electronic filter assembly of claim 1, wherein each of the prongs in the first set has a larger cross-sectional area than each of the prongs in the second set.

20. The electronic filter assembly of claim 1, wherein each of the prongs in the first set includes several layers of magnetically conductive material with each of the layers in each of the prongs has a different shape than an adjacent layer or adjacent layers in the same prong.

21. The electronic filter assembly of claim 10, wherein the one or more first separation gaps and the one or more second separation gaps are entirely filled with air.

22. The electronic filter assembly of claim 10, wherein the one or more first separation gaps and the one or more second separation gaps are entirely filled with a dielectric material other than air.

23. The electronic filter assembly of claim 10, wherein each of the prongs in the first set has a larger cross-sectional area than each of the prongs in the second set.

24. The electronic filter assembly of claim 10, wherein each of the prongs in the first set includes several layers of magnetically conductive material with each of the layers in each of the prongs has a different shape than an adjacent layer or adjacent layers in the same prong.

* * * * *